US009541340B2

(12) United States Patent
Fluhr et al.

(10) Patent No.: US 9,541,340 B2
(45) Date of Patent: Jan. 10, 2017

(54) MAGAZINE RELEASE APPARATUS AND FIREARMS INCLUDING SUCH MAGAZINE RELEASE APPARATUS

(71) Applicant: HECKLER & KOCH GmbH, Oberndorf (DE)

(72) Inventors: Norbert Fluhr, Oberndorf (DE); Daniel Kohler, Oberndorf-Boll (DE)

(73) Assignee: Heckler & Koch GmbH, Oberndorf (DE)

( * ) Notice: Subject to any disclaimer, the term of this patent is extended or adjusted under 35 U.S.C. 154(b) by 0 days.

(21) Appl. No.: 14/626,812

(22) Filed: Feb. 19, 2015

(65) Prior Publication Data

US 2016/0069628 A1 Mar. 10, 2016

Related U.S. Application Data

(63) Continuation of application No. PCT/EP2013/002909, filed on Sep. 27, 2013.

(30) Foreign Application Priority Data

Oct. 11, 2012 (DE) ..... 10 2012 019 911

(51) Int. Cl.

| | |
|---|---|
| ***F41A 9/61*** | (2006.01) |
| ***F41A 17/38*** | (2006.01) |
| ***F41A 35/06*** | (2006.01) |
| ***F41A 3/66*** | (2006.01) |

(52) U.S. Cl.

CPC ..... *F41A 17/38* (2013.01); *F41A 3/66* (2013.01); *F41A 35/06* (2013.01)

(58) Field of Classification Search

CPC ..... F41A 17/38; F41A 35/06; F41A 3/66
USPC ..... 42/6
See application file for complete search history.

(56) References Cited

U.S. PATENT DOCUMENTS 1,397,109 A * 11/1921 Pedersen ..... F41A 3/32 42/7
2,305,033 A * 12/1942 Roemer ..... F41A 17/38 42/18
3,568,348 A * 3/1971 Wilhelm ..... F41A 17/38 42/7

(Continued)

OTHER PUBLICATIONS

Dictionary.com (defining "retrofit"), Apr. 2, 2016.*

(Continued)

*Primary Examiner* — Michelle R Clement
(74) *Attorney, Agent, or Firm* — Hanley, Flight & Zimmerman, LLC

(57) ABSTRACT

Magazine release apparatus and firearms including such magazine release apparatus are disclosed. An example magazine release apparatus for use with a firearm includes a magazine retaining arm including a longitudinal slot, a first handle to protrude from a first side of the firearm and a second handle to protrude from a second side of the firearm. The second handle includes a rocker arm having a feature to be supported on a receiver of the firearm. The first and second handles are actuatable to move the magazine release apparatus between a magazine retaining position and a magazine releasing position. In the magazine retaining position, the second handle is at least partially supported by the longitudinal slot and the feature extends toward the receiver.

23 Claims, 7 Drawing Sheets

(56) References Cited

U.S. PATENT DOCUMENTS

| | | | | | |
|---|---|---|---|---|---|
| 4,521,985 | A * | 6/1985 | Smith | F41A 17/38 | 42/7 |
| 4,615,134 | A * | 10/1986 | Beretta | F41A 35/06 | 42/6 |
| 4,713,902 | A * | 12/1987 | Wigton | F41A 35/06 | 42/7 |
| 4,759,144 | A * | 7/1988 | Egan | F41A 35/06 | 42/7 |
| 4,949,492 | A * | 8/1990 | Clifton, Jr. | F41A 17/38 | 42/7 |
| 5,519,954 | A * | 5/1996 | Garrett | F41A 35/06 | 42/6 |
| 7,921,587 | B2 * | 4/2011 | Mayberry | F41A 21/481 | 42/49.01 |
| 8,806,788 | B1 * | 8/2014 | Hu | F41A 17/38 | 42/6 |
| 8,925,233 | B2 * | 1/2015 | Thordsen | F41C 27/00 | 42/50 |
| 8,978,282 | B2 * | 3/2015 | Garrett | F41A 17/38 | 42/6 |
| 9,121,651 | B1 * | 9/2015 | Jen | F41A 17/38 | |
| 2006/0123683 | A1 | 6/2006 | Garrett et al. | | |
| 2010/0281736 | A1 | 11/2010 | Mayberry et al. | | |
| 2013/0227869 | A1 * | 9/2013 | Thordsen | F41C 27/00 | 42/6 |
| 2014/0053444 | A1 * | 2/2014 | Garrett | F41A 17/38 | 42/6 |
| 2014/0338243 | A1 * | 11/2014 | La Vigne | F41A 35/06 | 42/16 |
| 2015/0330736 | A1 * | 11/2015 | Love | F41A 5/02 | 42/16 |
| 2016/0069628 | A1 * | 3/2016 | Fluhr | F41A 17/38 | 42/6 |

OTHER PUBLICATIONS

Knight's Armament Company, "Ambi-Mag Release w/Wrench", [http://www.knightarrnco.corn/shop/index.php?main_page=product_info&cPath=1&products_id=4], accessed on May 23, 2013, 3 pages.

Knight's Armament Company, "Ambidextrous Magazine Release Assembly", [http://shop.knightarmco.com/ProductDetails.aspx?ProductID=KM20470-1], accessed on Feb. 19, 2015, 3 pages.

International Searching Authority, "Written Opinion", issued in connection with PCT Application No. PCT/EP2013/002909, mailed on Dec. 10, 2013, including English translation, 18 pages.

International Searching Authority, "International Search Report", issued in connection with PCT Application No. PCT/EP2013/002909, mailed on Dec. 10, 2013, 4 pages.

German Patent and Trademark Office, "Office Action", issued in connection with German Application No. 10 2012 019 911.2, issued on May 7, 2013, including English translation, 16 pages.

Patent Cooperation Treaty, "International Preliminary Report on Patentability," issued in connection with PCT/EP2013/002909, mailed Apr. 23, 2015, 8 pages.

* cited by examiner

MAGAZINE RELEASE APPARATUS AND FIREARMS INCLUDING SUCH MAGAZINE RELEASE APPARATUS

RELATED APPLICATION

This patent is a continuation of International Patent Application Serial No. PCT/EP2013/002909, filed Sep. 27, 2013, which claims priority to German Patent Application 10 2012 019 911.2, filed on Oct. 11, 2012, both of which are hereby incorporated herein by reference in their entireties.

FIELD OF THE DISCLOSURE

This patent relates generally to release apparatus and, more specifically, to magazine release apparatus and firearms including such magazine release apparatus.

BACKGROUND

Various magazine releases and/or retaining apparatus may be used to retain a magazine within a magazine chamber of a firearm and/or to enable the magazine to be released from the magazine chamber to, for example, exchange the magazine.

Some magazines in accordance with NATO standards include a magazine catch on a left side of the magazine. If such a magazine is fully inserted into a magazine chamber of a firearm, a magazine latch of the firearm engages the magazine catch to secure the magazine within the firearm. The magazine latch may be a spring-loaded magazine releasing and/or retaining mechanism disposed in and/or on the weapon receiver. The magazine latch may be used in connection with magazine-loaded firearms such as, for example, rifles, assault rifles, light machine guns, submachine guns, pistols, etc.

To release the magazine from the firearm, in some examples, the magazine latch includes an actuatable handle. If a marksman actuates the handle, the magazine latch is moved away from the magazine catch to release the magazine and enable the magazine to be removed from the magazine chamber.

After the magazine is removed from the magazine chamber, a different magazine can be positioned within the magazine chamber and secured relative thereto based on the interaction between the magazine latch of the receiver and the magazine catch of the magazine. In some instances, a right-handed marksman may actuate the handle of the magazine latch using his/her index finger. Some magazine latches are only operable on the right side of the firearm. Thus, left handed marksmen may find difficulty actuating such magazine latches

DETAILED DESCRIPTION

Figure 1:
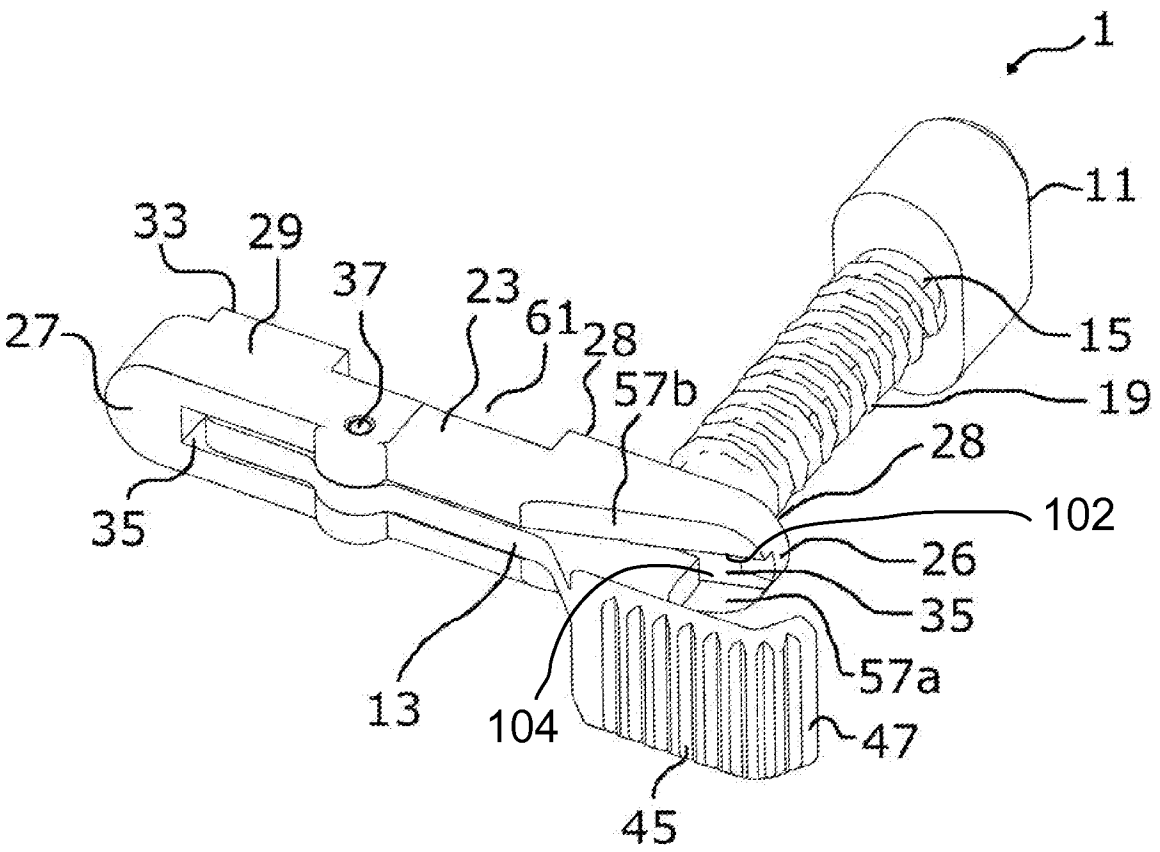
FIG. 1 shows a perspective view of an example magazine release apparatus in a magazine retaining position.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

Some magazine latches are operable from both the right side and the left side of the firearm. However, the structure of many of these magazine latches is very complex and protrudes from the firearm in a manner that promotes unintentional actuation of the magazine latch and the release of the magazine. Some of these magazine latches are difficult to integrate into existing weapon systems (e.g., firearms), have a bulky structure and may malfunction due to the introduction of contaminants (e.g., mud, dirt, etc.).

U.S. Pat. No. 4,615,134 mentions a magazine latch that is actuatable using a pushbutton on a right side of the firearm and/or a handle on the right side of the firearm. The handle mentioned in U.S. Pat. No. 4,615,134 is coupled to a bolt that is biased toward a magazine retaining position. When the handle is actuated, the bolt is moved against a spring force toward a magazine releasing position. An end of the handle mentioned in U.S. Pat. No. 4,615,134 faces the front of the firearm and, thus, is unable to be operated by the marksman when the hand of the marksman is located on the stock on firearm.

U.S. Pat. No. 4,521,985 mentions a magazine latch for a handgun that is actuatable from both sides of handgun using pushbuttons.

U.S. Pat. No. 4,759,144 mentions a magazine latch that is actuatable on a right side of the firearm using a pushbutton and on a left side of the firearm using a lever. The lever mentioned in U.S. Pat. No. 4,759,144 is coupled to a bolt that is biased toward a magazine retaining position. When the lever is actuated, the bolt is moved against the spring force toward a magazine releasing position.

U.S. Patent Publication No. 2010/0281736 mentions a magazine latch that is actuatable by moving a linear slider between a magazine retaining position and a magazine releasing position using a handle. The linear slider is actuatable from both the left side and the right side of the firearm.

U.S. Patent Publication No. 2006/0123683 mentions a magazine latch that is operable from a first side (e.g., a right side) of the firearm using a lever and from a second side (e.g., a left side) of the firearm by pushing an actuation bolt operatively coupled to the lever.

The website for Knight's Armament Company, www.knightarmco.com/shop, mentions a magazine latch that is operable from both sides of the firearm. This magazine latch is coupled to an existing linear slider to enable actuation from both sides.

The examples disclosed herein relate to example ambidextrous magazine release apparatus operable from both sides of the firearm. In some examples, the example magazine latches include example handles (e.g., levers, pushbuttons) that are disposed on respective sides of the firearm. The example handles are actuatable to move the example magazine release apparatus between a magazine releasing position and a magazine retaining position. In some examples, the example handle (e.g., the lever) is configured as a rocker arm that is supported by a receiver of the firearm and/or engages a surface of the receiver such that a pivot axis is provided between the rocker arm and the receiver. The examples disclosed herein also relate to buttstocks, firearms and/or receivers (e.g., lower receivers) and, more generally, firearms, firearm assemblies and/or portions thereof including the example ambidextrous magazine release apparatus.

Figure 2:
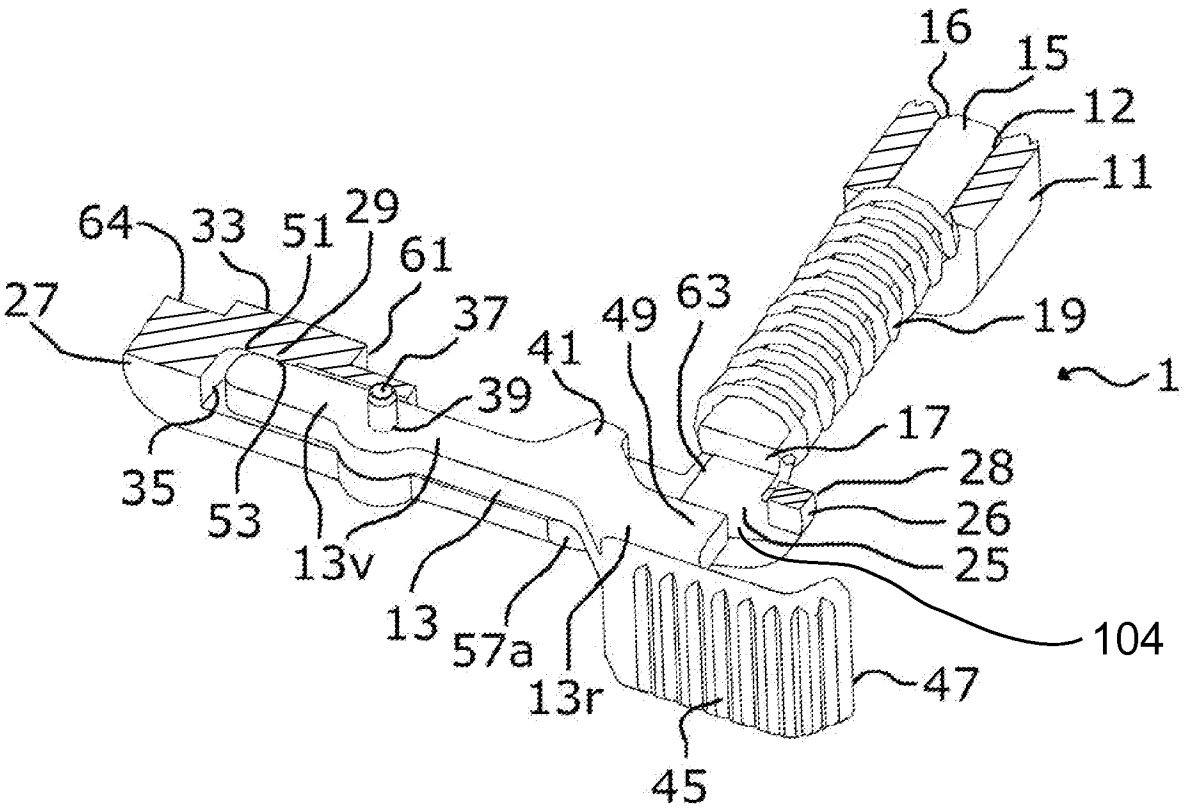
FIG. 2 shows a perspective cross-sectional view of the example magazine release apparatus of FIG. 1.
Figure 3:
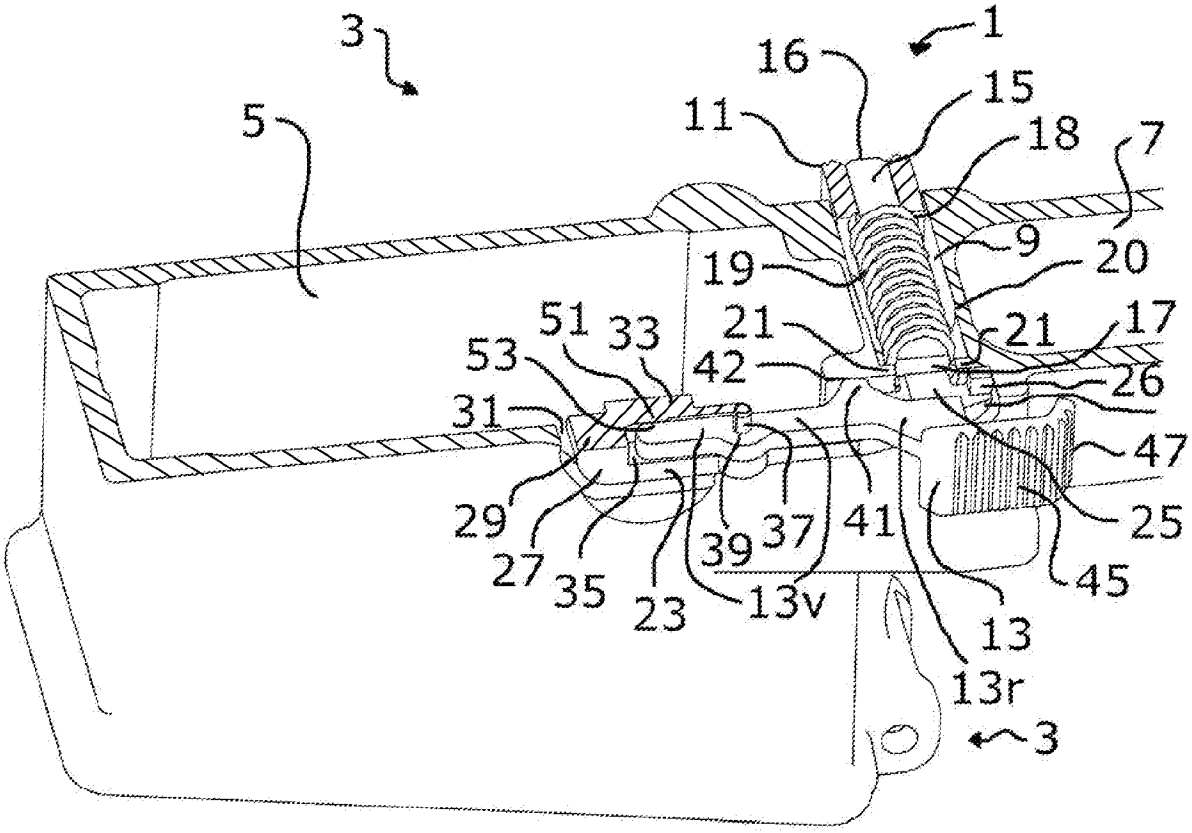
FIG. 3 shows a perspective cross-sectional view of the example magazine release apparatus disposed in an example receiver and/or an example firearm.

FIGS. 1-3 show an example magazine release apparatus 1 in accordance with the teachings of this disclosure. FIG. 1 shows an isometric and/or perspective view of the example magazine release apparatus 1, FIG. 2 shows an cross-sectional and/or perspective view of the example magazine release apparatus 1 and FIG. 3 shows an isometric and/or perspective view of the example magazine release apparatus 1 disposed in an example receiver (e.g., a lower receiver) 3 of an example firearm.

In some examples, the example magazine release apparatus 1 has an L-shape when viewed from above. In the illustrated example, the magazine release apparatus 1 includes an example first handle (e.g., a push button) 11, an example second handle (e.g., a magazine release lever) 13 and an example bolt 15 positioned between the first and second handles 11 and 13. To bias the bolt 15 toward a magazine retaining position, a biasing element(s) and/or spring(s) 19 is positioned around the bolt 15 between the first and second handles 11 and 13.

In some examples, the first handle 11 is configured as a pushbutton or knob that enables the operation of the magazine release apparatus 1 from a first side (e.g., a right side) of the receiver 3. In this example, the first handle 11 defines an aperture (e.g., a threaded aperture) 12 (FIG. 2) that receives a threaded end 16 (FIG. 2) of the bolt 15 to couple the first handle 11 to the bolt 15. However, the first handle 11 may be coupled to the bolt 15 in any other suitable manner.

In the illustrated example, an arm (e.g., a magazine retaining arm) 23 extends from a first end (e.g., a left end) 17 of the bolt 15 and is substantially transverse relative to the bolt 15. As used herein, the phrase substantially transverse means within a threshold of being transverse (e.g., +/−3 degrees) and/or accounts for manufacturing tolerances. In this example, the arm 23 is integrally formed with the bolt 15 and/or the arm 23 and the bolt 15 are unitary to substantially ensure a relatively high degree of stability for the magazine release apparatus 1. However, in other examples, the bolt 15 may be coupled to the arm 23 in any suitable manner (e.g., a threaded coupling, etc.).

Figure 5:
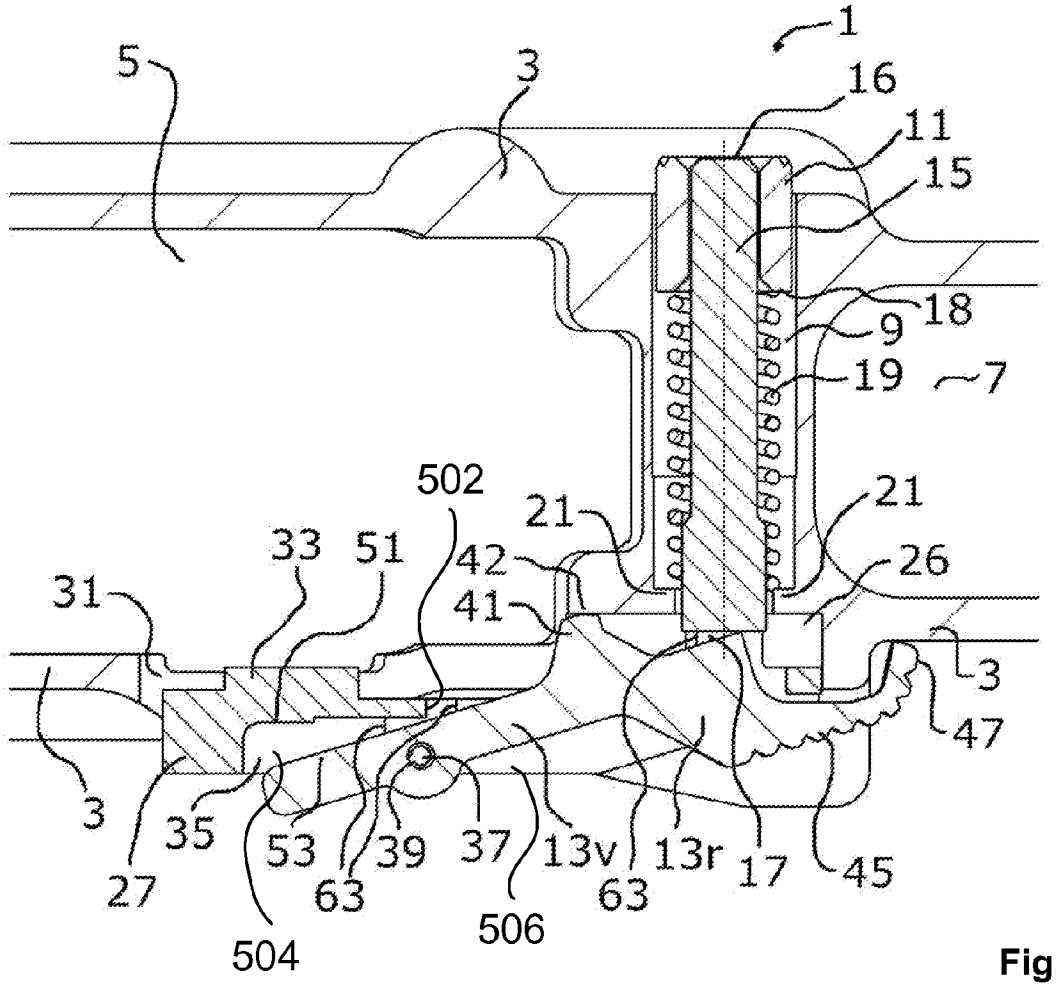
FIG. 5 shows a cross-sectional view of the example magazine release apparatus of FIG. 1 disposed in an example receiver of an example firearm, the example magazine release apparatus is shown in a magazine releasing position.

To actuate the magazine release apparatus 1, the first and/or second handles 11, 13 can be moved against the biasing force of the spring 19 toward a magazine releasing position as shown in FIG. 5. In the illustrated example, the arm 23 defines a longitudinal slot 35 that extends in the firing direction and is open toward a side of the firearm to enable the second handle 13 to be received by the longitudinal slot 35. In some examples, the longitudinal slot 35 has a U-shaped cross-section having an opening that faces away from the firearm. To enable the second handle 13 to interact with the receiver 3, a through slot and/or aperture 502 (FIG. 5) is defined toward the middle of the longitudinal slot 35.

In the illustrated example, to enable the magazine release apparatus 1 to be operated from the first side (e.g., a left side) of the firearm, the second handle 13 is at least partially disposed within the longitudinal slot 35 and includes a first and/or front lever arm 13*v* and a second and/or rear lever arm 13*r*. To secure a magazine within a magazine chamber 5, a rectangular magazine latch and/or protrusion 33 extends from a front region 29 of the arm 23 and is configured to matingly engage a corresponding structure and/or recess of a magazine disposed within the magazine chamber 5.

In some examples, the longitudinal slot 35 extends along substantially the entire length of the arm 23 and is at least partially defined by first and/or second (e.g., upper and lower) walls 102, 104 of the arm 23. In this example, at least one of the walls 102, 104 of the arm 23 defines a first guide surface 25 adjacent an end or rear 26 of the arm 23. As shown in FIG. 2, the first guide surface 25 enables the pivoting and/or rocking movement of the second handle 13 within the longitudinal slot 35. In some preferred examples, both of the walls 102, 104 are planar and transition into one of the first guide surfaces 25 that face toward the firearm and are disposed to the left of the bolt 15. In some examples, the first guide surface(s) 25 may also be disposed adjacent an aperture 39 through which a pin 37 extends to couple the second handle 13 to the arm 23 within the longitudinal slot 35.

Figure 4:
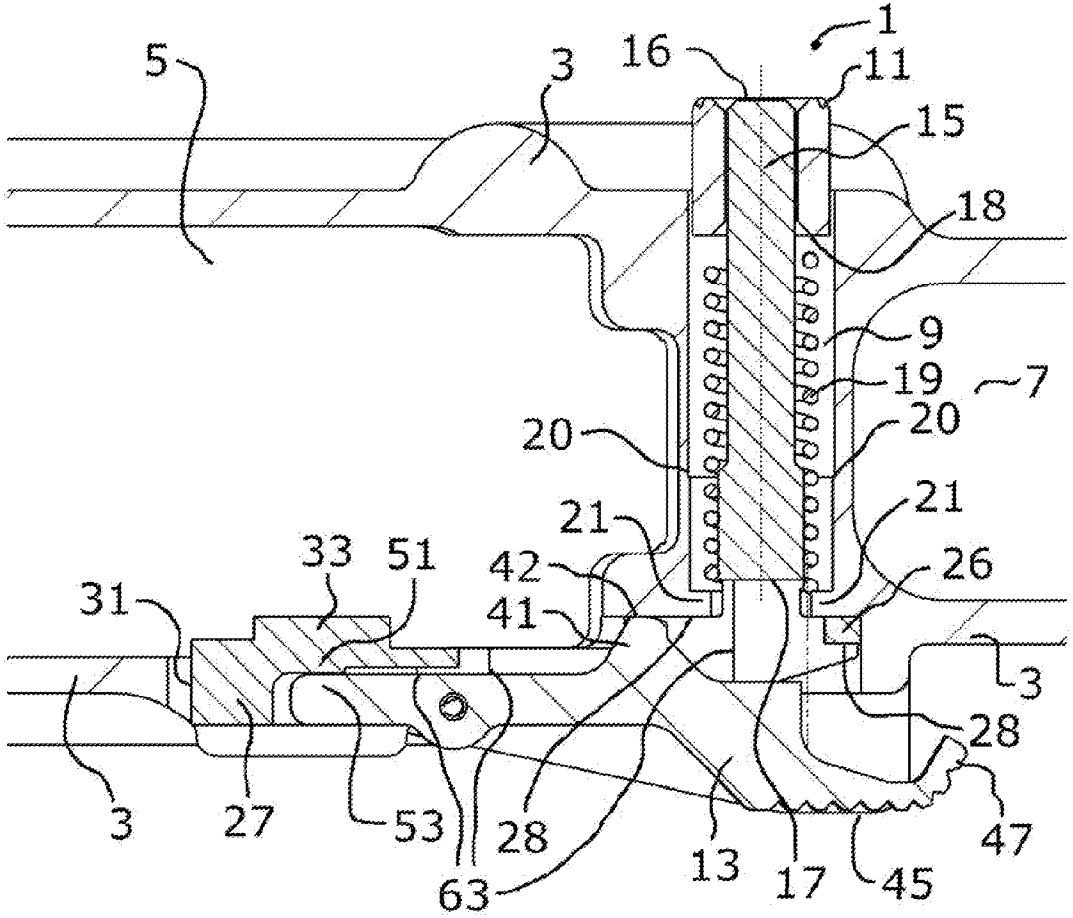
FIG. 4 shows a cross-sectional view of the example magazine release apparatus of FIG. 1 disposed in an example receiver of an example firearm, the example magazine release apparatus is shown in a magazine retaining position.

Referring to FIG. 2, a step 63 is defined on the second wall 104 that is to transition into the first guide surface 25. In some examples, both the first and second walls 102, 104 define such steps. As shown in FIGS. 4 and 5, the steps 63 are disposed on either side (e.g., the left side and the right side) of the aperture 39 to enable the second handle 13 to rest against the respective first guide surfaces 25 and not against other surfaces of the longitudinal slot 35. In this example, the first guide surfaces 25 define recesses 504, 506 therebetween that reduce the interaction between the second handle 13 and the surfaces of the surfaces walls 102, 104 defining the longitudinal slot 35 to reduce the likelihood that contamination (e.g., dirt) hinders the movement of the second handle 13.

In the illustrated example, the front and rear sides 27, 26 of the arm 23 border and/or partially define the longitudinal slot 35 in the longitudinal direction. When the magazine release apparatus 1 is disposed within the receiver 3, the rear 26 of the arm 23 rests against the receiver 3 with a second surface (e.g., a vertical surface, a support surface) 28 of the arm 23 facing the firearm when the magazine is removed (see FIGS. 1 and 4).

Figure 6:
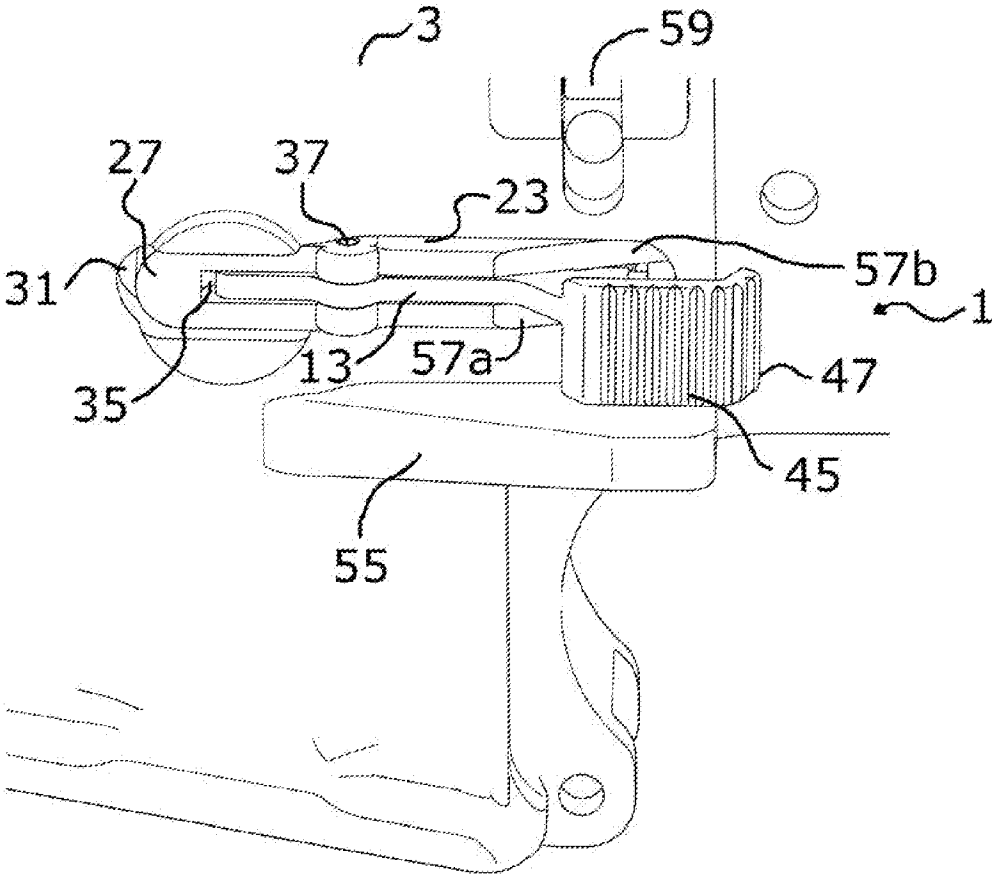
FIG. 6 shows a perspective view of the example magazine release apparatus of FIG. 1 disposed in an example receiver of an example firearm, the example magazine release apparatus is shown in a magazine retaining position.

In some examples, the rear 26 of the arm 23 is designed and/or configured to reinforce and/or stabilize the retaining arm 23. Referring to FIG. 6, to substantially ensure sufficient pivoting of the second handle 13, the rear 26 of the arm 23 includes third and fourth inclined surfaces 57*a*, 57*b*, which, in this example are parallel, ramp-like sections.

Referring to FIG. 1, to couple the second handle 13 to the arm 23, in the illustrated examples, an axle, coupling and/or pin (e.g., a locking pin) 37 extends through an aperture 39 of the second handle 13. In this example, the pin 37 is positioned toward a front region of the arm 23 and transfers the pivotal movement of the second handle 13 to linear movement of the arm 23.

As shown in FIG. 2, when the magazine release apparatus 1 is in the magazine retaining position, in some examples, a front inward facing surface and/or sixth support surface 53 of the second handle 13 rests against a seventh surface and/or support surface 51 of the longitudinal slot 35 of the arm 23. As shown in the example of FIGS. 3-5, the second handle 13 includes an inwardly facing protrusion, a pivot, a rocker pivot, a feature and/or a bulge 41 that extends into the aperture and/or slot 36 toward the firearm and engages and/or is supported by a eighth support surface 42 of the receiver 3. In the illustrated examples, an end 47 of the second handle 13 includes an arched and/or actuation surface 45 having surface structures and/or grooves to resist slipping, for example. The surface structures may be, for example, ribs, checkers, texturing, etc.

As shown in FIG. 3, the bolt 15 and/or the magazine release apparatus 1 extends through an aperture 9 of the receiver 3 and the interaction between the magazine release apparatus 1 and the receiver 3 supports the magazine release apparatus 1 relative to the firearm. In some examples, the interaction between the bolt 15 and the aperture 9 substantially ensures the movement of the arm 23 and the bolt 15 is substantially transverse relative to an axis of the barrel of the firearm. In this example, the aperture 9 is disposed between the magazine chamber 5 and a recess and/or aperture 7 that receives a trigger (e.g., a trigger mechanism). In some examples, the aperture 9 is substantially transverse relative to a barrel of the firearm. As shown in the example of FIG. 3, the bolt 15 passes entirely through the aperture 9 and includes a taper that begins adjacent a step 20 of the aperture 9 and extends toward the first handle 11. Depending on manufacturing, the step 20 of the aperture 9 and/or the taper of the bolt 15 may be differently positioned and/or differently configured and/or shaped.

In this example, at the end 17 of the bolt 15, the bolt 15 transitions into the arm 23 that is disposed outside of the receiver 3 and extends in the firing direction adjacent the magazine chamber 5. Thus, in this example, the arm 23 is substantially parallel to an axis of the bore and is substantially perpendicular to the bolt 15. As used herein, the phrase substantially parallel means within a threshold of parallel (e.g., +/−three degrees) and/or accounts for manufacturing tolerances. As used herein, the phrase substantially perpendicular means within a threshold of perpendicular (e.g., +/−three degrees) and/or accounts for manufacturing tolerances.

As shown in the example of FIG. 3, the spring 19 surrounds the bolt 15 and urges the magazine release apparatus 1 toward a magazine retaining position. In this example, the spring 19 is disposed in the aperture 9 between and engages a surface 18 of the first handle 11 and a surface and/or annular shoulder 21 of the receiver 3 to urge the magazine release apparatus 1 toward a magazine retaining position. In the illustrated example, the annular shoulder 21 defines an aperture and/or passage for the bolt 15 to move relative to and/or to extend out of and/or through the receiver 3. In some examples, ends of the spring 19 are flattened and/or bent to improve the interaction, engagement and/or support against the annular shoulder 21 and the first handle 11. However, in other examples, different types of springs may be used and/or the ends of the spring 19 may not be bent and/or flattened.

In the example of FIG. 3, the spring 19 urges the first handle 11 out of the aperture 9 and the receiver 3 into the magazine retaining position. Further, because in this example, the first handle 11, the bolt 15 and the arm 23 are coupled (e.g., integrally coupled), the spring 19 urges the arm 23 against the receiver 3 into the magazine retaining position. In this example, when the magazine is removed from the magazine chamber 5 and the magazine release apparatus 1 is in the magazine retaining position, the second surface 28 of the arm 23 is positioned immediately adjacent and/or lies against the receiver 3 and/or is disposed at least partially within the longitudinal groove 35.

As shown in the example of FIG. 3, to enable actuation of the magazine release apparatus 1 from the first side (right side) of the firearm, the first handle 11 extends from the first side of the receiver 3 and, to enable actuation of the magazine release apparatus 1 from the second side (left side) of the firearm, the second handle 13 extends from the second side of the receiver 3. In some examples, the second handle 13 is configured as a latch and/or rocker lever that extends outward to the left over the receiver 3 to enable its operation.

As shown in the example of FIG. 3, a front end 29 of the arm 23 is at least partially disposed in an aperture and/or cut-out 31 that extends through the receiver 3 to enable the magazine latch 33 to protrude toward and/or into the magazine chamber 5. Thus, in this example, when the magazine release apparatus 1 is in the magazine retaining position, the magazine latch 33 extends into and/or through the aperture 31 and into the magazine chamber 5 to engage a complementary recess of a magazine disposed in the magazine chamber 5 to securely retain the magazine in the magazine chamber 5. As shown in the example of FIG. 2, a recess (e.g., a rectangular recess), notch and/or step 61 is defined by the arm 23 between the magazine latch 33 and the second surface 28 of the arm 23. In this example, when a magazine is inserted into the magazine chamber 5 and the magazine release apparatus 1 is in the magazine retaining position, a ninth surface 64 of the arm 23 in front of the magazine latch 33 engages and/or rests against the magazine. In this example, the recess 61 of the arm 23 at least partially ensures that at least some surfaces defining the recess 61 are spaced from the magazine (e.g., an external surface of the magazine) when the magazine is disposed in the magazine chamber 5.

As shown in the example of FIG. 3, in the magazine retaining position, the sixth surface (e.g., a support surface) 53 of the second handle 13 engages and/or lies against the seventh support surface 51 of the arm 23. Further, as shown in the example of FIG. 3, in the magazine retaining position, the pivot 41 engages against a corresponding eighth support surface 42 of the receiver 3.

In some examples, because of the tolerances of the respective components, when the magazine is interested into the magazine chamber 5, a minimal amount of play and/or spacing may exist between support surfaces of the second handle 13 and the corresponding surfaces on the arm 23 and/or the receiver 3, thereby enabling the second handle 13 not to need additional support and/or to be subject to additional forces. In this example, because the second handle 13 is supported at two points (e.g., the pivot 41, the pin 37), the second handle 13 is substantially prevented against pivoting from the magazine retaining position and, thus, rests against the arm 23. In this example, the configuration of the second handle 13 substantially ensures that the second handle 13 is not inadvertently actuated and/or does not inadvertently move away from the magazine retaining position.

As shown in the example of FIG. 5, to move the magazine release apparatus 1 to the magazine releasing position, a marksmen moves one of the first or second handles 11, 13 to dislodge and/or move the magazine latch 33 away from the magazine chamber 5. Specifically, in this example, the marksmen can push the first handle 11 into the weapon receiver 3 or the marksmen can pivot the second handle 13 toward the receiver 3. For example, when the magazine release apparatus 1 is actuated from a first side (e.g., the right side), the marksmen pushes the first handle 11 into the receiver 3 against a force of the spring 19, thereby moving the magazine latch 33 from the retaining position based on the coupling between the first handle 11, the bolt 15 and the arm 23.

For example, when the magazine release apparatus 1 is actuated from a second side (e.g., the left side), the marksmen moves a second actuation surface 45 of the second handle 13 toward the receiver 3 to pivot the second handle 13, via the pivot 41, against the receiver 3 to position the front end 13*v* of the second handle 13 out of the longitudinal slot 35, away from the receiver 3 and against the force of the spring 19. Based on the pivoting movement of the second handle 13 about the pivot 41 and the coupling between the second handle 13 and the arm 23 at the pin 37, the pivoting movement of the second handle 13 is transferred into linear movement of the arm 23, the magazine latch 33 correspondingly moves away from the magazine chamber 5 and the first handle 11 is drawn and/or moved into the aperture 9 to position the magazine release apparatus 1 in the magazine releasing position.

As shown in the example of FIG. 5, in the magazine releasing position, the end 47 of the second handle 13 is disposed proximate and/or immediately adjacent the receiver 3 and the recess 7 that is to receive the trigger mechanism. Further, as shown in the example of FIG. 5, in the magazine releasing position, the rear 26 of the arm 23 is spaced from the receiver 3 and the magazine latch 33 is spaced from the magazine chamber 5. As shown in the example of FIG. 5, while moving toward the magazine releasing position, the pivot 41 transitions, rolls and/or moves over the receiver 3 and toward the magazine chamber 6 (e.g., compare FIGS. 4 and 5). In the magazine releasing position of the magazine release apparatus 1, the marksmen can remove the magazine from the magazine chamber 5 or the magazine can be released (e.g., falls) from the magazine chamber 5 if the firearm is being held in the normal firing position. In the examples disclosed herein, when the marksmen releases the first and/or second handles 11 and/or 13, the magazine release apparatus 1 returns to the magazine retaining position. In the examples disclosed herein, when a marksmen inserts a magazine into the magazine chamber 5, the magazine passes over and/or depresses the magazine latch 33 via, for example, a ramp on the magazine and/or a ramp on the magazine latch 33, to enable magazine to be moved toward the magazine retaining position and for the magazine latch 33 to return, via the spring 19, to secure the magazine in the magazine chamber 5.

Figure 7:
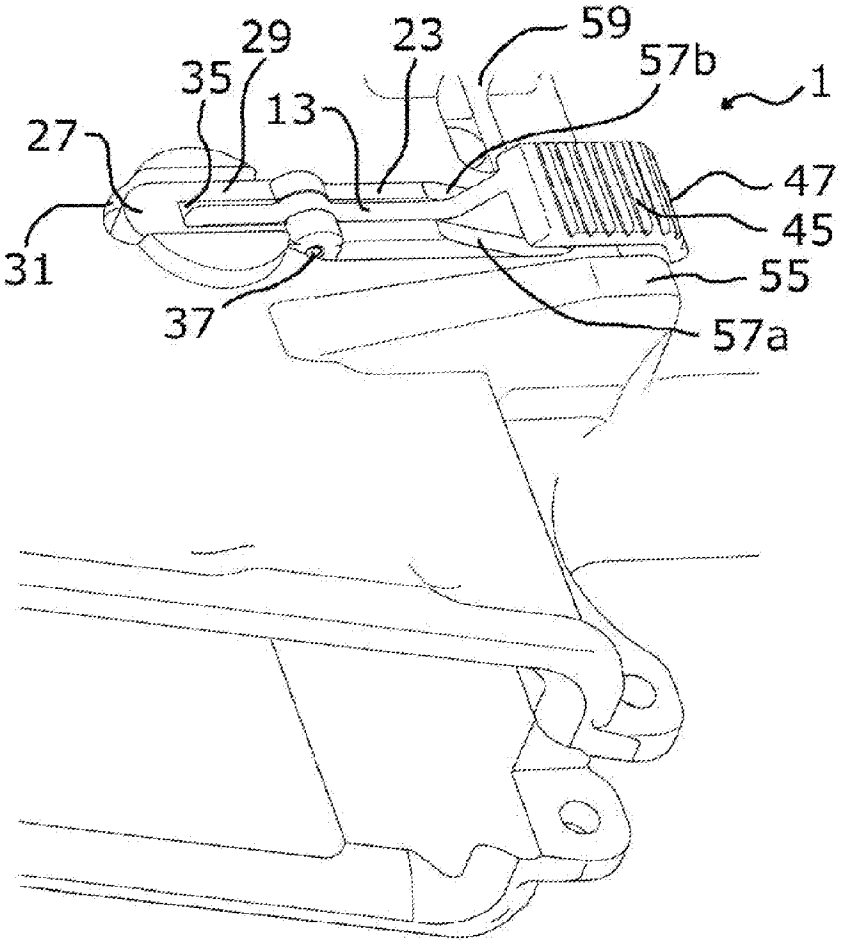
FIG. 7 shows another perspective view of the example magazine release apparatus of FIG. 6 disposed in an example receiver of an example firearm.

The examples of FIGS. 6 and 7 show different perspective views of the magazine release apparatus 1 within the receiver 3 and in the magazine retaining position. As shown in the example of FIG. 6, the receiver 3 extends upward and/or above the magazine release apparatus 1. In this example, a slot-shaped hole and/or aperture 59 is defined by the receiver 3 above the magazine releasing apparatus 1 to receive, for example, a slide stop lever. As shown in the example of FIGS. 6 and 7, a projection and/or guard projection 55 is disposed and/or positioned below the magazine releasing apparatus 1 and extends from the receiver 3. In some examples, the guard projection 55 substantially prevents the second handle 13 from being inadvertently actuated by the marksmen and/or substantially protects the second handle 13 against damage (e.g., bending, breaking) caused by, for example, an accidental impact.

Some magazine releasing apparatus are relatively bulky and may become caught on clothing and/or unintentionally actuated. The support for some magazine releasing apparatus is outside of the receiver and behind an actuation bolt that acts as a spring seal. Some magazine releasing apparatus include a lever attached to a magazine retaining arm that is subject to the action of a spring on the side of an axis facing away from the marksmen causing a back portion of the lever to press against the outer surface of the receiver with a contact bulge (e.g., a feature) of the lever.

The examples disclosed herein relate to magazine releasing and/or retaining apparatus for firearms (e.g., rifles, handguns, assault rifles, shotguns, long guns, sub-machine guns, machine guns, short guns, etc.) that are reliably operable from both sides (e.g., ambidextrous, left and right sides) of the firearm. In some examples, an example magazine releasing and/or retaining apparatus includes a magazine retaining arm having a longitudinal slot that passes through it. In some examples, a handle is supported in the longitudinal slot when the magazine release apparatus is in the magazine retaining position. In some examples, the magazine releasing and/or retaining apparatus includes a bulge, a feature and/or protrusion that is disposed in the longitudinal slot and engages the receiver and acts as a rocker axis. In some examples, firearms include the example magazine release apparatus disclosed herein to increase the reliability and/or functionality of such firearms.

In some examples, the example magazine releasing apparatus may be cost-effectively manufactured using metal casting processes, metal injection molding processes (MIM processes) and/or sintering processes. In some examples, the longitudinal slot is formed as a cut-out and/or a milled groove.

In some examples, the pivot point and/or bulge rests against the receiver and stabilizes the handle on the receiver. In some examples, supporting the handle at a single point against the receiver reduces the likelihood of contamination entering and/or reducing the performance of the magazine release apparatus. As disclosed herein, because the pivot point and/or bulge acts as a rocker axis, the pivot point continuously engages and, thus, is supported against the receiver as the magazine releasing apparatus transitions between and is positioned in the magazine retaining position and the magazine releasing position. In some examples, as the magazine release apparatus transitions between the magazine retaining position and the magazine releasing position, the pivot point and/or bulge acts as a fulcrum that rolls against and/or relative to the receiver enabling the bulge to be in a relatively defined position that enables the secure transfer of forces.

In some examples, because the handle is supported in the magazine retaining arm, the arm is relatively balanced with respect to the magazine releasing apparatus. Further, because in some examples, the handle is supported in the magazine retaining arm, the handle is substantially unable to be unintentionally pivoted away from the receiver and/or buttstock, when the magazine release apparatus is in the magazine retaining position. Further, because in some examples, the handle is supported in the magazine retaining arm, the handle is relatively securely fixed and/or protected against damage.

The example magazine release apparatus according to the examples disclosed herein is relatively shorter and protrudes less from the firearm as compared to some magazine releasing/retaining mechanisms. Further, because in some examples, the handle is received inside the magazine retaining arm, a flatter and/or more compact structure can be obtained as compared to some magazine releasing/retaining mechanisms.

In some examples, the weapon receiver is a single unit weapon receiver and/or a multi-piece weapon receiver including an upper receiver and a lower receiver. The example magazine release apparatus is included with the receiver at a suitable position. In some examples, the lower receiver is a buttstock module, a buttstock module including a magazine chamber for receiving a magazine, a buttstock module including a mount to receive a trigger mechanism, a buttstock module having a magazine chamber and a mount for a trigger mechanism, a buttstock module including a trigger mechanism and a shoulder support and/or a buttstock module having a magazine chamber, a mount for a trigger mechanism and/or a shoulder support. In some examples, the buttstock is a buttstock for firearms.

In some examples, the second handle is supported in a longitudinal slot when the magazine is removed from the magazine retaining position. In some examples, a front of the handle faces the firing direction and a rear of the handle includes a curved surface and/or manipulation surface.

The example magazine release apparatus has a compact construction that also securely supports the handle. In some preferred examples, to substantially protect the lever arm against accidental actuation, contamination and/or damage, the lever arm is substantially received in the longitudinal slot with the magazine release apparatus is in the magazine retaining position.

In some examples, the lever arm is coupled to the magazine retaining arm in an articulating manner in the longitudinal slot, thereby enabling a short lever stroke. In some examples, a surface of the receiver against which the bulge and/or pivot point of the lever engages is disposed between a pivot joint and a movement axis of the lever. In some examples, to provide for a compact structure and to reduce the susceptibility of contamination, the surface that is engaged by the bulge is located in front of the bolt of the magazine release apparatus that is received in the receiver. In some examples, an elastic element (e.g., a spring(s), rubber, bellevue washers, a biasing element, etc.) holds the magazine release apparatus in the magazine retaining position, under tension, in an elastic manner. In some examples, the magazine retaining position is a position in which a magazine latch engages a magazine to retain the magazine within a magazine chamber. To remove a magazine from the magazine chamber, a marksmen moves the magazine release apparatus into the magazine releasing position to move the magazine latch to disengage the magazine catch of the magazine.

In some examples, to enable reproducible movement of the lever and/or substantially prevent tilting of the lever, a section of the back lever arm is guided lengthwise along a guide surface formed on and/or in the magazine retaining arm. As disclosed herein, the magazine release apparatus can be actuated to the magazine release position from either side of the firearm using, for example, the first handle and/or the second handle. In some examples, the hand that actuates the magazine release apparatus may also be the hand that removes the magazine from the magazine chamber. In some examples, a marksmen uses his/her index finger of the shooting hand to actuate the magazine release apparatus. Using the examples disclosed herein, the magazine release apparatus can be ergonomically actuated by both right-handed and left-handed marksmen. For example, the marksmen can actuate the magazine release apparatus by pushing the first handle into the receiver and/or by pivoting the second handle toward the receiver. In some examples, when the second handle is pivoted against the spring force, the second handle rests against the receiver and the pivoting action of the bulge and/or pivot point against the receiver and the articulated connection between the second handle and the magazine retaining arm withdraws the magazine latch away from the magazine chamber and moves the magazine retaining arm substantially parallel relative to and away from the receiver to release the magazine.

In some examples, to increase the operability of the example magazine release apparatus in all conditions (e.g., rain, water, snow, etc.) and/or when the marksmen is wearing gloves, the lever and/or handle of the magazine release apparatus includes slip resistant surface structures (e.g., ribs, texture, checkers, a coating, a rubber coating, grooves, corrugations, etc.).

In some examples, an existing firearm can be retrofitted with the example magazine release apparatus. For example, the example magazine release apparatus can be used to easily retrofit an existing firearm having a buttstock and/or receiver without, for example, mechanically reworking the firearm. Some firearms that can be retrofitted with the example magazine release apparatus include, for example, the M16 and/or any other firearm that is to be ergonomically optimized using the magazine release apparatus as disclosed herein.

In some examples, the example magazine release apparatus is included as a component of a firearm and/or a lower receiver of a firearm when the firearm is initially manufactured and/or sold. Some firearm components and/or assemblies such as, for example, an upper receiver and/or a lower receiver, are sometimes sold as individual assemblies. In such examples, an example magazine release apparatus according to the examples disclosed herein can be included with such firearm components and/or assemblies as sold.

In some preferred examples, one or more protrusions and guard projections are disposed on the buttstock and/or adjacent the magazine release apparatus to, for example, protect the handle of the magazine release apparatus against damage. In some examples, the guard projection(s) outwardly protrudes from the receiver and/or the buttstock proximate one of the handles (e.g., the first handle, the second handle). The guard projection(s) can be formed and/or produced when casting and/or producing the receiver and/or the buttstock and/or may be an add-on component. In some examples, the guard projection(s) substantially prevents the magazine release apparatus from being unintentionally actuated (e.g., actuating the magazine release while firing the firearm would negatively impact the functionality of the firearm). Further, in some examples, the guard project(s) protects the corresponding handle(s) from being damaged if, for example, the firearm is impacted and/or dropped.

As set forth herein, an example magazine releasing/retaining mechanism 1 that can be operated from both sides for a firearm includes a magazine retaining arm 23, and handles 11, 13 protruding on both sides of the firearm, for transferring the magazine retaining arm 23 from its magazine retaining position to its magazine releasing position, and vice versa. In some examples, one of the handles 13 is designed as a rocker lever. The rocker axis is supported on the weapon receiver 3. The magazine retaining arm 23 has a longitudinal slot 35 passing through it. The handle 13 is supported in the longitudinal slot 35 in its magazine retaining position, and includes a bulge 41 serving as the rocker axis that is fitted into the longitudinal slot toward the weapon receiver 3.

In some examples, the handle 13 is supported in the longitudinal slot 35 in the front region of its front lever arm 13*v* extending in the firing direction, and has the second actuation surface 45 at the back of its back lever arm 13*r*. In some examples, the front lever arm 13*v* is largely accommodated in the longitudinal slot 35 when in its magazine retaining position. In some examples, the magazine retaining arm 23 and the front lever arm 13*v* are connected in an articulated manner to one another in the longitudinal slot 35. In some examples, the magazine releasing/retaining mechanism 1 is retained by an elastic element 19 in a spring loaded manner in its magazine retaining position. In some examples, at least one section of the rear lever arm 13*r* extending toward the back is guided along at least one of the first guide surfaces 25 formed on/in the magazine retaining arm 23. In some examples, the magazine releasing/retaining mechanism 1 can be transferred from the magazine retaining position to the magazine releasing position by means of pressure exerted by a shooter on either of its two handles 11, 13.

In some examples, at least one of its handles 11, 13 has a slip resistant manipulation surface 45. In some examples, the magazine releasing/retaining mechanism 1. In some examples, is designed as a retrofitting set for firearms. In some examples, a buttstock and/or the receiver 3 for a firearm includes the magazine releasing/retaining mechanism 1. In some examples, the buttstock and/or the receiver 3 has at least one guard projection 55 for at least one handle 11; 13 of the magazine releasing/retaining mechanism 1. In some examples, a weapon receiver 3 for a firearm includes a magazine releasing/retaining mechanism 1. In some examples, the weapon receiver 3 according has at least one guard projection 55 for at least one handle 11; 13 of the magazine releasing/retaining mechanism 1.

The examples disclosed herein relate to an example magazine releasing/retaining mechanism (1) that can be operated from both sides of a firearm. The example magazine releasing/retaining mechanism (1) includes a magazine retaining arm (23) and handles (11, 13) protruding on both sides of the firearm for transferring the magazine retaining arm (23) from a magazine retaining position to a magazine releasing position, and vice versa. In some examples, one of the handles (13) is designed as a rocker lever having a rocker axis supported on the weapon receiver (3). In some examples, the magazine releasing/retaining mechanism (1) includes the magazine retaining arm (23) has a longitudinal slot (35) passing through it, the handle (13) is supported in the longitudinal slot (35) when in the magazine retaining position. One of the handles (13) includes a bulge (41) serving as the rocker axis, which is fitted into the longitudinal slot toward the weapon receiver (3). The disclosed examples also relate to both a buttstock as well as a weapon receiver (3) for a firearm, which are equipped, respectively, with a magazine releasing/retaining mechanism (1) of this type.

An example magazine release apparatus for use with a firearm includes a magazine retaining arm including a longitudinal slot, a first handle to protrude from a first side of the firearm and a second handle to protrude from a second side of the firearm. The second handle includes a rocker arm having a feature to be supported on a receiver of the firearm. The first and second handles are actuatable to move the magazine release apparatus between a magazine retaining position and a magazine releasing position. In the magazine retaining position, the second handle is at least partially supported by the longitudinal slot and the feature extends toward the receiver.

In some examples, a front of the second handle is supported in the longitudinal slot extending in a firing direction and a rear of the second handle comprises an actuation end. In some examples, a front of the second handle is substantially positioned within the longitudinal slot in the magazine retaining position. In some examples, the second handle is coupled to the magazine retaining arm in an articulating manner within the longitudinal slot. In some examples, the magazine retaining arm is biased toward the magazine retaining position. In some examples, movement of the second handle is at least partially guided by an interaction between a surface of the second handle and a guide surface of the magazine retaining arm. In some examples, actuating the first handle or the second handle is to move the magazine retaining arm to the magazine releasing position. In some examples, the first handle or the second handle includes a slip resistant surface or surface structure. In some examples, the magazine release apparatus includes a retrofit magazine release apparatus. In some examples, the retaining arm and the first handle are unitary.

An example portion of a firearm includes a receiver and a magazine release apparatus for use with the firearm. The magazine release apparatus includes a magazine retaining arm including a longitudinal slot, a first handle to protrude from a first side of the firearm and a second handle to protrude from a second side of the firearm. The second handle includes a rocker arm having a feature to be supported on a receiver of the firearm. The first and second handles are actuatable to move the magazine release apparatus between a magazine retaining position and a magazine releasing position. In the magazine retaining position, the second handle is at least partially supported by the longitudinal slot and the feature extends toward the receiver. In some examples, the portion of the firearm includes a projection adjacent the first handle or the second handle. In some examples, the feature is a bulge (e.g., a projection).

In some examples, an example magazine release apparatus includes a magazine retaining arm defining a longitudinal slot and a rocker arm coupled to the magazine retaining arm to enable the rocker arm to move the magazine retaining arm between a magazine retaining position and a magazine releasing position. In the magazine retaining position, the rocker arm is at least partially supported by the longitudinal slot and a pivot axis of the rocker arm is to extend toward and be supported against a receiver of a firearm. In some examples, the rocker arm is coupled to the magazine retaining arm in an articulating manner within the longitudinal slot. In some examples, the magazine retaining arm is biased toward the magazine retaining position. In some examples, movement of the rocker arm is at least partially guided by an interaction between a surface of the rocker arm and a guide surface of the magazine retaining arm. In some examples, the rocker arm includes a first handle to protrude from a first side of the firearm. In some examples, the portion of the firearm includes a second handle to protrude from a second side of the firearm, actuating the first handle or the second handle is to move the magazine retaining arm to the magazine releasing position. In some examples, the first handle or the second handle includes a slip resistant surface or surface structure. In some examples, the magazine release apparatus includes a retrofit magazine release apparatus.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A magazine release apparatus for use with a firearm, comprising:

a magazine retaining arm comprising a longitudinal slot;

a first handle to protrude from a first side of the firearm;

a second handle to protrude from a second side of the firearm, the second handle comprising a rocker arm comprising a feature to be supported on a receiver of the firearm, the first and second handles being actuatable to move the magazine release apparatus between a magazine retaining position and a magazine releasing position, in the magazine retaining position, the second handle is at least partially supported by the longitudinal slot and the feature extends toward the receiver.

2. The magazine release apparatus of claim 1, wherein a front of the second handle is supported in the longitudinal slot extending in a firing direction and a rear of the second handle comprises an actuation end.

3. The magazine release apparatus of claim 1, wherein a front of the second handle is substantially positioned within the longitudinal slot in the magazine retaining position.

4. The magazine release apparatus of claim 1, wherein the second handle is coupled to the magazine retaining arm in an articulating manner within the longitudinal slot.

5. The magazine release apparatus of claim 1, wherein the magazine retaining arm is biased toward the magazine retaining position.

6. The magazine release apparatus of claim 1, wherein movement of the second handle is at least partially guided by an interaction between a surface of the second handle and a guide surface of the magazine retaining arm.

7. The magazine release apparatus of claim 1, wherein actuating the first handle or the second handle is to move the magazine retaining arm to the magazine releasing position.

8. The magazine release apparatus of claim 1, wherein the first handle or the second handle comprises a slip resistant surface or surface structure.

9. The magazine release apparatus of claim 1, wherein the magazine release apparatus is to be used to retrofit the firearm.

10. The magazine release apparatus of claim 1, wherein the retaining arm and the first handle are unitary.

11. A portion of a firearm, comprising:

a receiver; and a magazine release apparatus for use with the firearm, the magazine release apparatus comprises:

a magazine retaining arm comprising a longitudinal slot;

a first handle to protrude from a first side of the firearm; and a second handle to protrude from a second side of the firearm, the second handle comprising a rocker arm comprising a feature to be supported on a receiver of the firearm, the first and second handles being actuatable to move the magazine release apparatus between a magazine retaining position and a magazine releasing position, in the magazine retaining position, the second handle is at least partially supported by the longitudinal slot and the feature extends toward the receiver.

12. The portion of the firearm of claim 11, further comprising a projection adjacent the first handle or the second handle.

13. The portion of the firearm of claim 11, wherein the feature comprises a bulge.

14. A magazine release apparatus, comprising:

a magazine retaining arm defining a longitudinal slot;

a rocker arm coupled to the magazine retaining arm to enable the rocker arm to move the magazine retaining arm between a magazine retaining position and a magazine releasing position, in the magazine retaining position, the rocker arm is at least partially supported by the longitudinal slot and a pivot axis of the rocker arm is to extend toward and be supported against a receiver of a firearm.

15. The magazine release apparatus of claim 14, wherein the rocker arm is coupled to the magazine retaining arm in an articulating manner within the longitudinal slot.

16. The magazine release apparatus of claim 14, wherein the magazine retaining arm is biased toward the magazine retaining position.

17. The magazine release apparatus of claim 14, wherein movement of the rocker arm is at least partially guided by an interaction between a surface of the rocker arm and a guide surface of the magazine retaining arm.

18. The magazine release apparatus of claim 14, wherein the rocker arm comprises a first handle to protrude from a first side of the firearm, further comprising a second handle to protrude from a second side of the firearm, wherein actuating the first handle or the second handle is to move the magazine retaining arm to the magazine releasing position.

19. The magazine release apparatus of claim 18, wherein the first handle or the second handle comprises a slip resistant surface or surface structure.

20. The magazine release apparatus of claim 14, wherein the magazine release apparatus is to be used to retrofit a firearm.

21. The magazine release apparatus of claim 1, wherein the feature is to engage the receiver in the magazine retaining position and the magazine releasing position.

22. The magazine release apparatus of claim 1, further including a bolt coupled between the first handle and the magazine retaining arm, the second arm being coupled to the magazine retaining arm via a pin, the feature being positioned between the pin and the coupling between the bolt and the magazine retaining arm.

23. The magazine release apparatus of claim 22, wherein the bolt and the magazine retaining arm are integral.

* * * * *